US005655208A

United States Patent [19]

Sahay et al.

[11] Patent Number: 5,655,208

[45] Date of Patent: Aug. 5, 1997

[54] MODULAR MULTI-FUNCTION IMAGE-FORMING APPARATUS FOR PRINTING MIXED SIDED AND MIXED COLOR COPY SETS

[75] Inventors: Ravi B. Sahay; David H. Feather, both of San Diego, Calif.

[73] Assignee: Ravi & Associates, San Diego, Calif.

[21] Appl. No.: 518,755

[22] Filed: Aug. 24, 1995

[51] Int. Cl.[6] ..... G03G 15/00; G03G 15/01

[52] U.S. Cl. ..... 399/397; 271/277; 399/304; 399/401; 399/403; 399/404

[58] Field of Search ..... 355/313, 319, 355/326 R, 327, 323; 399/388, 403, 404, 397, 401, 297, 304, 303, 305, 309, 407; 271/275, 277

[56] References Cited

U.S. PATENT DOCUMENTS

| | | | |
|---|---|---|---|
| 4,278,344 | 7/1981 | Sahay | 355/319 |
| 4,538,906 | 9/1985 | Brown | 355/319 |
| 4,641,954 | 2/1987 | Miyata et al. | 355/323 X |
| 5,138,399 | 8/1992 | Castelli et al. | 355/327 |
| 5,155,538 | 10/1992 | Monfalcone | 355/313 |
| 5,162,859 | 11/1992 | Hirono et al. | 355/313 |
| 5,164,769 | 11/1992 | Hashimoto et al. | 355/323 X |
| 5,166,738 | 11/1992 | Tani | 355/319 |
| 5,192,977 | 3/1993 | Kaneko et al. | 355/313 |
| 5,347,351 | 9/1994 | Morita et al. | 355/313 |
| 5,443,256 | 8/1995 | Ertavi et al. | 271/277 |
| 5,579,691 | 12/1996 | Voge | 271/277 X |

*Primary Examiner*—S. Lee
*Attorney, Agent, or Firm*—Frank G. Morkunas

[57] ABSTRACT

A modular copier/printer or similar image forming apparatus of the type having an image transfer body in the form of a drum or belt allows documents to be reproduced in a paper discharge mode which discharges paper sheets, or recording media, in page-sequential order. When an automatic two-sided copy mode is selected, the apparatus automatically sets up the page sequential paper discharge mode to a "collation mode" through a minimum number of sorter bins which has been optimally designed to correspond with the shortest two-sided copy loop. Hence, when mixed black-and-white documents and color documents are reproduced together in the automatic copy mode, paper sheets exit the apparatus in the correct page order. As a result of this automatic change in operating modes, fewer "skip" frames need be introduced during the copying operation, thereby enabling the copier to produce multiple collated copies of the multipage document very efficiently.

10 Claims, 3 Drawing Sheets

MODULAR MULTI-FUNCTION IMAGE-FORMING APPARATUS FOR PRINTING MIXED SIDED AND MIXED COLOR COPY SETS

BACKGROUND OF THE INVENTION

The present invention relates to a modular copier, laser printer or similar image forming apparatus of the type having a transfer body in the form of a drum or a belt and, more particularly, to an image forming apparatus operable in a page-sequential paper discharge mode which discharges recording media, or paper sheets with one-sided and two-sided and color and black and white images, in correct page order and with high productivity.

DESCRIPTION OF THE PRIOR ART

In the case of a conventional two-sided image forming apparatus having a digital scanner and document feeder, copying operations for mixed jobs containing two-sided or color jobs are carried out in the following manner:

When a large number of documents are to be continuously copied, an operator checks whether they are one-sided or two-sided documents or black and white or color. If one of the pages is two-sided, then, the operator usually selects the automatic two-sided mode for the whole job. Similarly, if one of the pages is color, then, the operator usually selects the full color mode for the whole job. After that, a copy start command is given to the apparatus. In this mode should a toner image representative of black and white be transferred to the paper in the same manner as a toner image of a color document or should a toner image representative of one-sided blank image be transferred to the paper in the same manner as a toner image of a two-sided document, the productivity rate (copying rate) would be critically lowered although paper sheets would be discharged in order of page despite the mixture of two different kinds of documents. Therefore, the copying operation for sets of mixed originals is very inefficient.

In the case where mixed documents including one-sided and two-sided documents are continuously copied with the image forming apparatus, sometimes the operator will sort the documents into one-sided and two-sided pages, and then the operator designates the copy mode for each of the one-sided and two-sided page sets so as to carry out a copying operation and then manually merge them to complete the job. This operation is very cumbersome and inefficient due to the manual intervention.

U.S. Pat. No. 5,162,859 (Ricoh Company Ltd., Hirono et al.) describes an image forming apparatus which prints two-sided mixed color and black and white jobs automatically. However, such an apparatus has various problems as enumerated below:

(a) two image transfer stations are required—one directly from the image recording device and another from the intermediate transfer belt, (b) a long and winding paper path and intermediate image transfer belt are required, (c) black and white images must be read in a direction opposite to a color image, (d) a complex control algorithm involving forward or reverse document scanning, mirror or non-mirror write modes and complex inversion in the paper transport during discharge is required, and (e) while the apparatus is automatic it is inefficient due to many skipped frames in the straight duplex mode.

U.S. Pat. No. 4,278,344 (Xerox Corporation, Sahay) and U.S. Pat. No. 5,166,738 (Ricoh Company Ltd., Tani) are applicable for black and white copying only. U.S. Pat. No. 5,155,538 (Eastman Kodak Company, Manfalcone) is relevant for a two color copier or printer only.

All the patents and applications cited herein for background or art purposes are also incorporated by reference herein to the extent they provide teachings of usable or alternative systems or hardware for the disclosed embodiments herein.

SUMMARY OF THE INVENTION

It is therefore an object of the present invention to provide a copier, laser printer or similar image forming apparatus capable of discharging paper sheets in order of page rapidly in any of various copy modes which are practicable with a mixed stack of black and white documents and color documents both one-sided and two-sided. It is another object of the present invention to provide a modular and simplified image forming apparatus, which can be configured in many different ways to efficiently satisfy different market productivity and capability requirements.

The image forming apparatus assumes a supply means to supply the digital documents, which has a built-in or programmed discrimination means to discriminate whether the document pages are one-sided or two-sided, and also to discriminate whether the pages are black and white or color. Then the image forming apparatus selectively outputs copy sheets in either a one-sided copy mode, two-sided copy mode or mixed copy mode.

A preferred feature of the embodiment is to provide an efficient method for copying documents containing a mix of single-sided and two-sided black and white or color pages by plurally recirculating said documents and serially copying said documents during said plural recirculations, wherein the number of said plural circulations is determined by the number of copy sets being made and the minimum number of intermediate sorter bins; the improvement comprising copying multiple copies of the said documents in a first succession until the two-sided paper path loop is filled and then copying the other side of said two-sided copy in a second succession and then exiting them into intermediate sorter bins, whose number is determined by the maximum number of copy sheets in the two-sided copy loop.

Another preferred feature of the embodiment is to provide a method for reducing the frequency of digital bitmap image swaps for a given copy throughput rate thereby reducing the cost of the digital image supply means; the improvement comprising copying multiple copies of documents upon each recirculation and exiting the copies into said intermediate sorter bins.

The preferred embodiment herein discloses a circular image drum or belt and circular transfer drum architecture. Transfer is located in the twelve o'clock position and development is located between the four and eight o'clock positions. The transfer drum includes a mechanical registration mechanism for both A4 and A3 size paper. The transfer drum serves to complete the path of the two-sided copy loop thereby minimizing the total length of the path and associated number of intermediate sorter bins. By design the architecture includes a short, straight paper path located at convenient height above the floor. The resulting configuration is straight forward, elegant and concise.

The preferred embodiment herein discloses a module design rule which allows modules to be configured in many different ways to efficiently satisfy different market productivity and capability requirements; the improvement comprising the requirement that the paper input and output points be identically located on opposite sides of each module. This requirement enables the chaining together of identical and different modules to efficiently provide a variety of products for different markets and applications.

BRIEF DESCRIPTION OF THE DRAWINGS

The above and other objects, features and advantages of the present invention will become more apparent from the following detailed description taken with the accompanying drawings in which.

DETAILED DESCRIPTION OF THE INVENTION

Reference Numerals in Drawings

Figure 1:
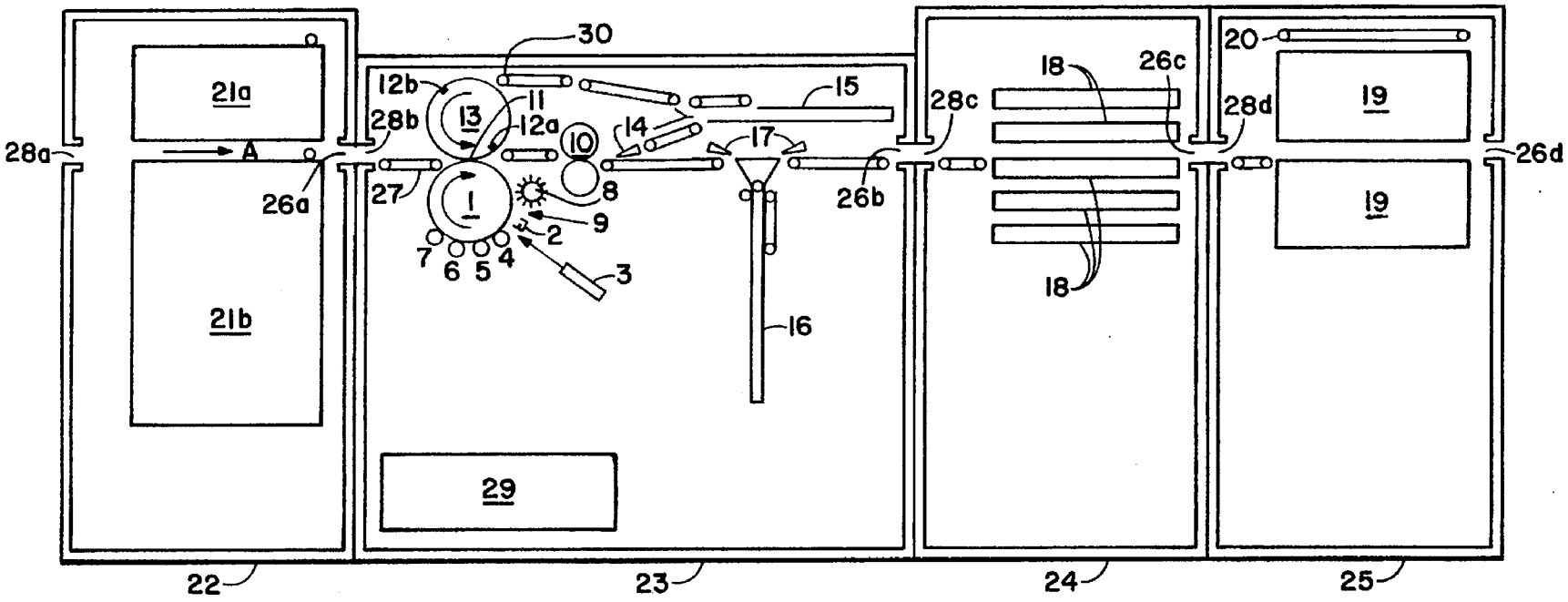
FIG. 1 is a front view section showing a specific construction of a color printer which is a specific form of an image forming apparatus embodying the present invention.

1 photoreceptor drum or belt
2 charging station
3 exposing station
4,5,6,7 cyan, magenta, yellow, black developing stations
8 cleaning station
9 erasing station
10 fusing station
11 transferring station
12 registration gripper
13 transfer drum
14 two-sided copy gate
15 two-sided copy invertor
16 exit invertor
17 exit invertor gate
18 intermediate sorter bin
19 elevator stacker
20 bypass transport
21 input paper tray
22 paper input module
23 marking module
24 productivity module
25 output stacker module
26 paper output port
27 registration wait gate
28 paper input port
29 apparatus controller

Figure 2:
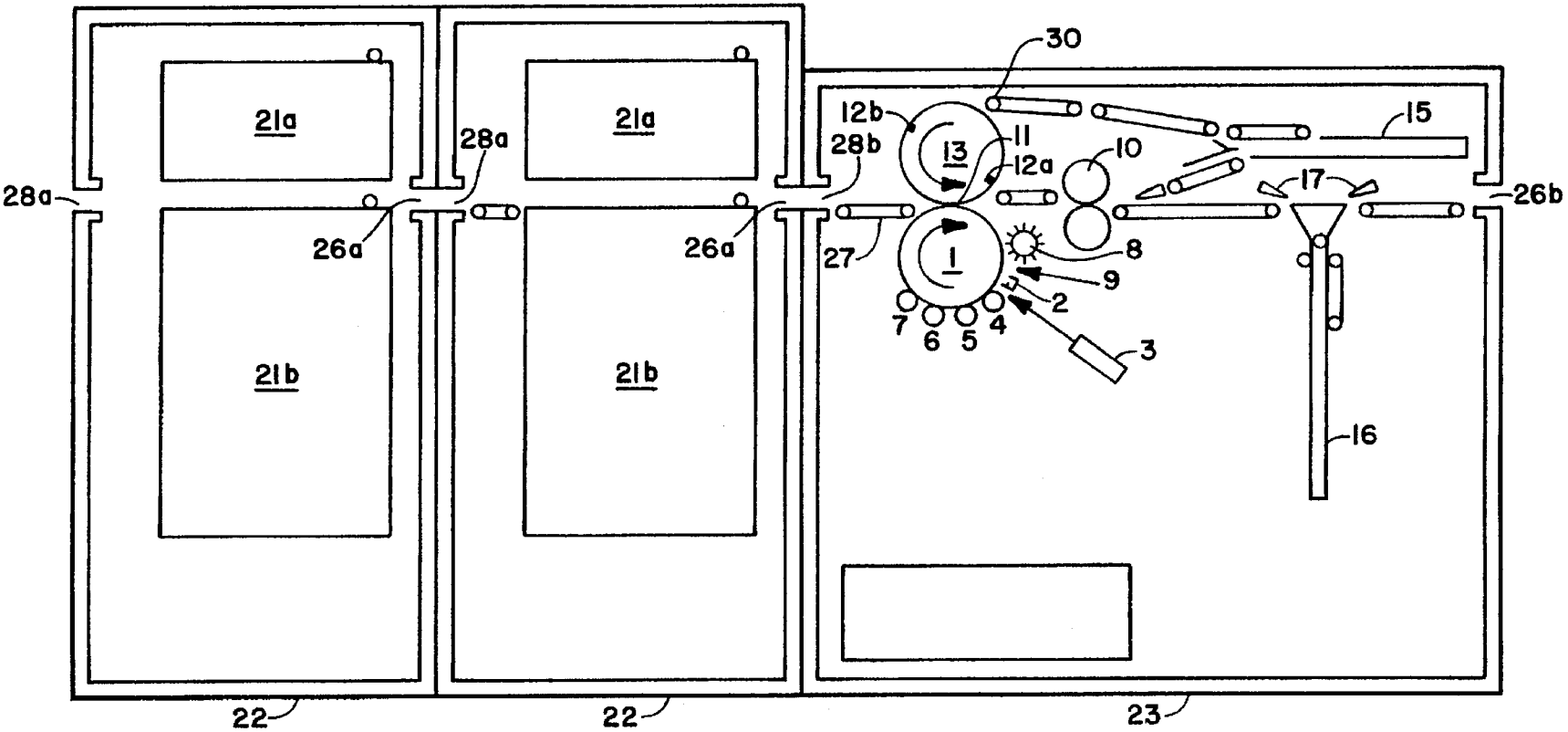
FIG. 2 is a front view section showing an example of a specific construction of a color printer with two paper input modules which is a specific form of an image forming apparatus embodying the present invention.
Figure 3:
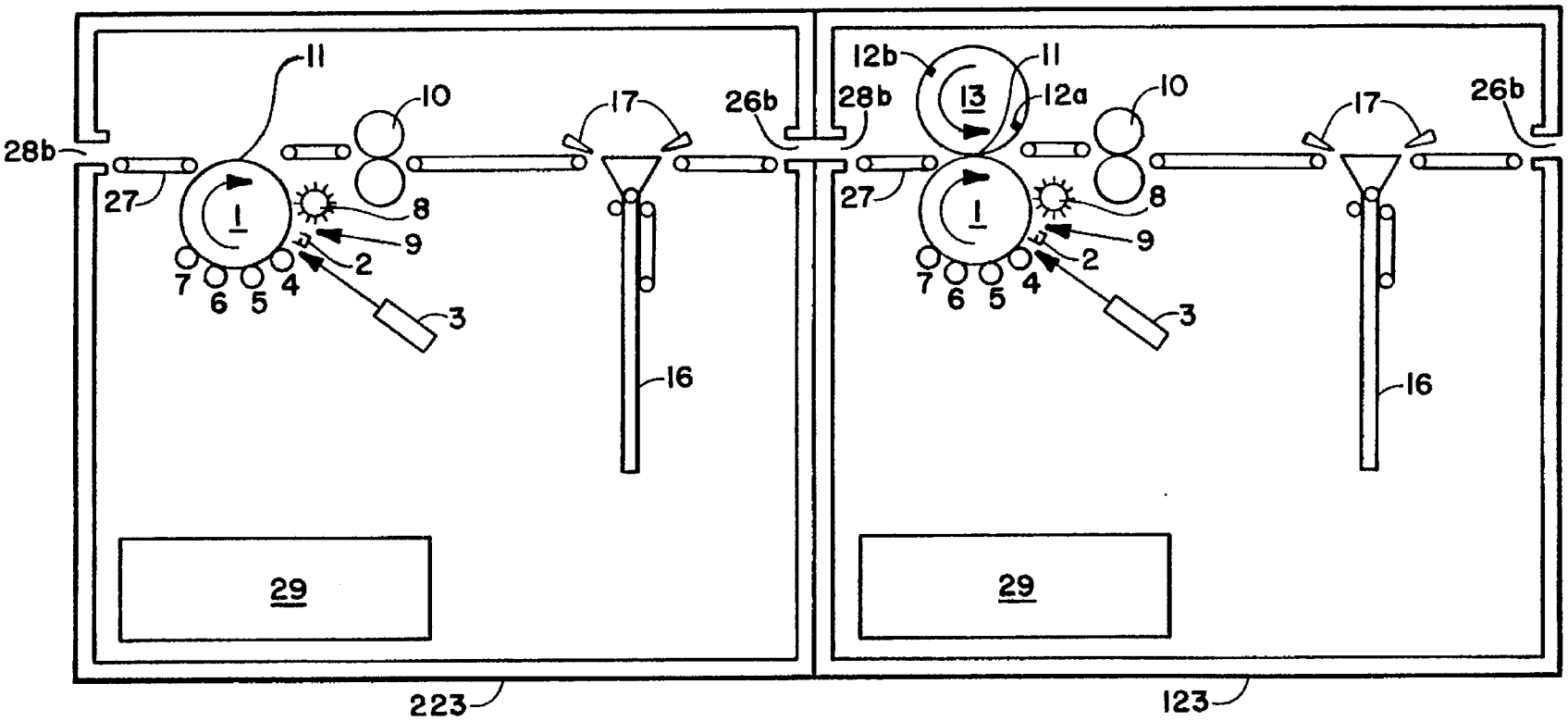
FIG. 3 is a front view section showing an example of a specific construction of a tandem color printer configured by chaining together two marking modules which is a specific form of an image forming apparatus embodying the present invention.

Description—FIGS. 1 to 3

Referring to FIG. 1, a modular image forming apparatus embodying the present invention is shown and implemented as a color copier/printer having an image writing device, developing devices, an image transfer device, a fixing device, a paper feeding device, a two-sided copy loop, paper transporting devices and an output stacking device. The apparatus is modular in that it consists of a linear arrangement of paper input module 22, followed by marking module 23, followed by productivity module 24, followed by output stacker module 25. Such linear arrangements are possible because the sheet feeding means comprising a paper input port 28*a*, 28*b*, 28*c*, and 28*d*, referred to respectively as first paper input port, second paper input port, third paper input port, and fourth paper input port, on the left hand side of each module has the same physical location as the paper output port 26*a*, 26*b*, 26*c*, and 26*d*, referred to respectively as first paper output port, second paper output port, third paper output port, and fourth paper output port, on the right hand side of each module. As illustrated in FIG. 1, first paper output port 26*a* of paper input module 22 cooperates with second paper input port 28*b* of marking module 23; second paper output port 26*b* of marking module 23 cooperates with third paper input port 28*c* of productivity module 24; and third paper output port 26*c* of productivity module 24 cooperates with fourth paper input port 28*d* of output stacker module 25. Reference arrow A depicts the direction of travel for a copy sheet.

The exemplary xerographic copier/printer and its apparatus controller 29 as the apparatus discrimination means, shown in FIG. 1 will now be described in further detail. Two input paper trays 21 are shown in paper input module 22. Marking module 23 includes a photoreceptor drum or belt 1 and stations acting thereon for respectively charging 2, exposing 3, developing multiple colors 4, 5, 6, 7, transferring 11, cleaning 8 and erasing 9. Transferred images are fixed to the paper by passing the sheet through fusing station 10. The copier/printer is adapted to provide mixed one-sided and two-sided page-sequential copy sets comprised of black and white and color images. The control of sheet feeding is conventional, by apparatus controller 29. Apparatus controller 29 is preferably a known programmable microprocessor which also controls all of the other apparatus functions described herein. Marking module 23 includes two registration wait gates, a first registration wait gate 27 and a second registration wait gate 30, a transfer drum 13 with two registration grippers 12, a two-sided copy gate 14, a two-sided copy invertor 15, exit invertor gates 17 and an exit invertor 16. Productivity module 24 contains five intermediate sorter bins 18. Output stacker module 25 contains two elevator stackers 19 and a bypass transport 20.

FIG. 2 shows an example of an alternative linear arrangement of modules comprised of two paper input modules 22 followed by one marking module 23. FIG. 3 shows another example of a linear arrangement of modules comprised of two or more alternate marking modules 123 and 223. The alternate marking modules 123 and 223 are structured substantially similarly as is the marking module 23 except that the alternate marking modules do not generally include the two-sided-copy gate 14, the two-sided copy invertor 15, or the second registration wait gate 30. Additionally, alternate marking module 223 does not include a transfer drum 13 and the registration grippers 12*a* and 12*b*. This configuration would be appropriate for high speed two-sided printing and as such the two-sided copy paths have been removed from each module.

Referring to FIG. 1, clean copy sheets are first fed from one of the input paper trays 21*a* and 21*b* to the first to registration wait gate 27. The two paper trays can hold any type of copy paper. Typically, one tray holds one type of paper, such as, but not limited to standard 8½"×11", while the other tray holds another type, such as, but not limited to A4. At the appropriate time, the sheet is refed to registration gripper 12*a* where the sheet is gripped and transported through xerographic transfer station 11 where upon the transfer of a monochrome toner image from photoreceptor drum or belt 1 to one side of the sheet occurs. The copy sheet is mechanically registered against first registration gripper 12*a* and held against transfer drum 13 by static electricity forces. If a monochrome image is desired, first registration gripper 12*a* is released after transfer and the sheet passes into fusing station 10 for image fixing. Unless two-sided copying is detected by the apparatus controller 29, the copy sheet is then advanced from the transfer station 11 to the second output port 26*b*. This is referred to as the first mode of operation and involves only a single pass transfer (multiple or single revolutions of photoreceptor 1) single color or multicolor copying. If multiple revolution, multiple pass transfer (on transfer drum 13) or two-sided copying is desired and detected by the apparatus controller 29, the process enters either one or both of what is referred to as the second mode of operation and the third mode of operation, respectively.

For multiple revolution, multiple pass copying, the color copying process is accomplished such that the cyan, magenta, yellow, and black images are separately transferred onto a sheet of copy paper and overlaid on each other sequentially during multiple revolutions of the photoreceptor drum 1 at the transfer station 11. Before each succeeding revolution, the photoreceptor 1 is cleaned. During each revolution, the charging station 2 and the exposing station 3 engage with the respective color development stations 4, 5, 6, and 7 to develop the image on the photoreceptor 1.

For multiple revolution, single pass transfer operation, the color processing is accomplished such that the cyan, magenta, yellow, and black images are overlaid on each other on the photoreceptor 1 sequentially during multiple revolutions of the photoreceptor 1. During each such revolution, the charging station 2 and the exposing station 3 engage with the respective color development stations 4, 5, 6, and 7 to develop the image on the photoreceptor 1. The developed color image is then transferred onto the sheet of copy paper only once at the transfer station 11.

In the single revolution, single pass transfer, the color processing is accomplished by adding multiple charging stations and multiple exposure stations for each separate color such that the cyan, magenta, yellow, and black images are overlaid on each other by the respective development stations 4, 5, 6, and 7 on the photoreceptor 1 sequentially during one revolution of the photoreceptor. The developed image is then transferred onto the sheet of copy paper only once at the transfer station 11.

For multiple-pass transfer color copying the sheet is held on transfer drum 13 by the registration means and is re-fed to the transfer station 11 until the desired number of colors is achieved followed by transport into the fusing station 10. Whereas for single revolution single pass transfer color copying or multiple revolution single pass transfer color copying, the copy sheet is fed to the transfer station 11 one time followed by transport into the fusion station 10. Unless two-sided copying was also detected, the copy sheet is advanced from the transfer station 11 to the second output port 26*b*. This is the second mode of operation. At least two copy sheets can be held onto the transfer drum 13 by the first registration gripper 12*a* and by the second registration gripper 12*b*.

For two-sided copying, after fusing, the copy sheets are fed to the two-sided copy gate 14 which functions as a one or two-sided copy selector. Depending on the position of the two-sided copy gate, up or down, the copy sheets will either be deflected upward, with the gate down, into the two-sided copy inverter 15 or will continue straight, with the gate up, to the exit invertor gate 17 and out the second output port 26*b*. This is the third mode of operation.

In the event a two-sided copy is desired, the sheet is transported upward into two-sided copy invertor 15 and refed to second registration wait gate 30. At the appropriate time, the sheet is refed to first registration gripper 12*a* or second registration gripper 12*b*. The respective grippers are on substantially opposite diametric ends of each other. As a result of this configuration, the respective registration grippers provide the registration means for holding more than one sheet of copy paper at a time and assisting in the movement through transfer station 11. Each gripper can grip, hold, and move a sheet of copy paper. When a sheet is so gripped it is gripped and transported through xerographic transfer station 11 one or more times where upon the transfer of a monochrome or colored toner image from photoreceptor drum or belt 1 to the second side of the sheet occurs. Upon complete image transfer, first registration gripper 12*a* is released after transfer and the sheet passes into fusing station 10 for second side image fixing.

Exit invertor gate 17 can now be employed to invert the sheet if an image side up copy sheet orientation is desired. In the event exit invertor gate 17 is closed, the copy sheet will be deflected downward into exit invertor 16 and refed to the second output port 26*b*. In the event the exit invertor gate 17 is open, the copy sheet will bypass the exit invertor 16, will be inverted, and then be acquired by the second output port 26*b* for final exit or for transport into one or more intermediate sorter bins 18 and/or one or more stacker modules 25.

The fixed copy sheet is now transported into productivity module 24. According to the preferred embodiment of the present invention, the productivity module optimally contains a number of intermediate sorter trays 18, the number being referred to as N. N is derived from the width of the copy paper being used or W and the length of the holding section or HS. The holding section is that distance beginning substantially from transfer station 11 up from the two-sided copy gate 14, into the complete length of the two-sided copy invertor 15, and up to the second registration gripper 12*b*. N, therefore, is the lowest whole number as derived from HS/W. Where N is a predetermined quantity, HS is derived from N×W. An efficient value for N is about three to six copy sheets of standard size 8½" by 11" or A4 paper. For optimum results, N is a value of about five such sheets, or their substantial equivalent. The number of bins and the number of copies to be made relate directly to the value N. In this regard, apparatus controller 29 contains an algorithm such that print jobs involving N or more copies per original will be printed in integer multiples of N at a time so long as N or more copies remain to be printed. Taken together these conditions will minimize the number of skipped or lost process pitches and thereby maximize apparatus productivity. The apparatus controller provides the logic means and the control means for detecting which operating mode should be engaged, how many copies are required, whether two-sided or single-sided, whether color or black and white, how many sheets can be temporarily and movingly held in the holding section in relation to how many intermediate bins 18 or N are contained within the productivity module 24, whether copies will be inverted by the exit invertor gate 17, and for emitting a signal to each respective responsible structure to engage in the operations so detected. Maximizing use of the holding section based on the mode of operation will reduce the frequency of digital bitmap swaps needed to make multiple copies and will minimize the quantity of skip frames associated with multiple copying.

By way of illustration, consider a monochrome job that requires fourteen copies of a six page document comprised of three one-sided sheets followed by three two-sided sheets. To facilitate face-up stacking, the job is printed last sheet first. According to prior art, this job might be printed using the two-sided mode. In this event 168 process frames would be required to print the job. A second possibility according to prior art, would be to only apply the two-sided mode to the three two-sided sheets. In the event the two-sided copy loop capacity was five sheets, 154 process frames would be required to print the job. Now consider the preferred embodiment of the present invention—the addition of an N tray productivity module with its associated productivity control algorithm. In this case, five copies of the last sheet would be printed and sorted followed by five copies of the second to last sheet and so on until five complete sets were completed and ejected into either elevator stacker 19 in output stacker module 25 or transported through and out of the module using bypass transport 20 to a finisher of some known type. This process would then be repeated to create five more sets. To complete the job, four copies of the last sheet would next be printed and sorted followed by four copies of the second to last sheet and so on. In this event only 129 process frames would be required to print the job.

A second important system benefit results from use of said productivity module 24. As has been pointed out, the presence of productivity module 24 permits the printing of images N at a time instead of one at a time as is done using the prior art. Because N images are printed from each digital bitmap, the time available to create the bitmap increases by a factor of N. In certain instances this increase in image processing time could substantially reduce the cost of the image processing subsystem.

In summary, the present invention provides a modular image forming apparatus which is simple, versatile and efficient. Modularity is achieved by designing identically located input and output paper ports into each apparatus module. The apparatus employs a sort two-sided copy loop, an N bin productivity module 24, and associated productivity algorithm to maximize productivity in the case of page-sequentially ordered mixed one-sided and two-sided jobs. A second important system benefit results from use of said productivity module 24. As has been pointed out, the presence of productivity module 24 permits the printing of images N at a time instead of one at a time as is done using the prior art. Because N images are printed from each digital bitmap, the time available to create the bitmap increases by a factor of N. In certain instances this increase in image processing time could substantially reduce the cost of the image processing subsystem.

Various modifications will become possible for those skilled in the art after receiving teachings of the present disclosure without departing from the scope thereof.

We claim:

1. An image forming apparatus comprising:

a. a photoreceptor for recording an image thereon;

b. at least one exposing station comprising a digital means for projecting said image onto said photoreceptor to thereby record at least one latent image on said photoreceptor;

c. a plurality of development stations having more than one toner color for selectively applying a toner color to said photoreceptor to render said latent image visible thereby producing a toner image;

d. a transfer station for transferring said toner image from said photoreceptor to one or more copy sheets presented thereto to create one or more first imaged copies;

e. sheet-feeding means for conveying said one or more copy sheets seriatim to said transfer station to receive said toner images from said photoreceptor, said sheet-feeding means being operable in a plurality of modes, said plurality of modes comprising a first mode to advance said one or more first imaged copies from said transfer station to an output port, a second mode to reconvey said one or more first imaged copies through said transfer station to enable said one or more first imaged copies to apply at least a second toner color, and a third mode to advance said one or more first imaged copies from said transfer station to a two-sided copy gate and to a transfer drum for re-application to said transfer drum through said transfer station for exposing on a second side of said one or more first imaged copies a second latent image received by said photoreceptor, said transfer drum further having a registration gripper means comprising at least a first registration gripper and a second registration gripper, said first and second registration grippers being on diametrically opposite ends of one another and holding at least two copy sheets;

wherein said one or more first imaged copies is advanced to said transfer station said one or more first imaged copies can be selectively diverted to said first mode for output, to said second mode for applying additional toner colors thereon, and to said third mode to produce one or more second imaged copies on said second side, said one or more second imaged copies thereafter can be selectively conveyed to said second mode and to said first mode.

2. The apparatus defined in claim 1 further comprising a logic and control means for detecting which one or more of said plurality of modes will be executed, for controlling said one or more plurality of modes, and for directing said one or more plurality of modes wherein said one or more copy sheets can thereby receive more than one toner color on a first side of said one or more copy sheets, can receive more than one toner color on a second side of said one or more copy sheets, and can create a predetermined plurality of copies in said second mode and said third mode in incremental numbers equal to a number of copy sheets holdable on said transfer drum by said registration gripper means until such time as all said predetermined plurality of copies have been made thereby minimizing skips frames and reducing in frequency digital bitmap swaps necessary to create such copies.

3. The apparatus as defined in claim 2 further comprising a plurality of modules comprising at least one input module for storing for use a plurality of copy sheet sizes, said input module having a first paper input port and a first paper output port; and at least one marking module containing an imaging apparatus for creating a plurality of single-sided and two-sides copies in one or more colors, said marking module having a second paper input port and a second paper output port, said respective modules interchangeably connected by their respective paper input ports and paper output ports.

4. The apparatus as defined in claim 3 further comprising at least one productivity module containing a plurality of sorter bins for storing said one or more first or second imaged copies after said one or more first or second imaged copies exit said second paper output port, said productivity module having a third paper input port and a third paper output port, said respective modules interchangeably connected by their respective paper input ports and paper output ports.

5. The apparatus as defined in claim 4 further comprising at least one stacker module for stacking a completed set of said one or more first or second imaged copies, said stacker module having a fourth paper input port and a fourth paper output port; said respective modules interchangeably connected by their respective paper input ports and paper output ports.

6. An image forming apparatus comprising:

a. a photoreceptor for recording an image thereon;

b. at least one exposing station comprising a digital means for projecting said image onto said photoreceptor to thereby record at least one latent image onto said photoreceptor;

c. a plurality of development stations having more than one toner color for selectively applying a toner color to said photoreceptor to render said latent image visible thereby producing a toner image;

d. a transfer station for transferring said toner image from said photoreceptor to one or more copy sheets presented thereto to create one or more first imaged copies;

e. sheet-feeding means for conveying said one or more copy sheets seriatim to said transfer station to receive said toner images from said photoreceptor, said sheet-feeding means being operable in a plurality of modes, said plurality of modes comprising a first mode to advance said one or more first imaged copies from said transfer station to an output port, a second mode to reconvey said one or more first imaged copies through said transfer station to enable said one or more first imaged copies to apply at least a second toner color, and a third mode to advance said one or more first imaged copies from said transfer station to a two-sided copy gate for re-application to said transfer station for exposing on a second side of said one or more first imaged copies a second latent image received by said photoreceptor, said two-sided copy gate having a holding section to hold said one or more first imaged copies; and f. a plurality of sorter bins substantially equal in number to a number of said one or more first imaged copies holdable in said holding section;

wherein said one or more first imaged copies is advanced to said transfer station said one or more first imaged copies can be selectively diverted to said first mode for output, to said second mode for applying additional toner colors thereon, and to said third mode to produce one or more second imaged copies on said second side, said one or more second imaged copies thereafter can be selectively conveyed to said second mode and to said first mode.

7. The apparatus defined in claim 6 further comprising a logic and control means for detecting which one or more of said plurality of modes will be executed, for controlling said one or more plurality of modes, and for directing said one or more plurality of modes wherein said one or more copy sheets can thereby receive more than one toner color on a first side of said one or more copy sheets, can receive more than one toner color on a second side of said one or more copy sheets, and can create a predetermined plurality of copies in said second mode and in said third mode in incremental numbers equal to the number of said sorter bins until such time as all said predetermined plurality of copies have been created thereby minimizing skips frames and reducing in frequency digital bitmap swaps necessary to create such copies.

8. The apparatus as defined in claim 6 further comprising a plurality of modules comprising at least one input module for storing for use a plurality of copy sheet sizes, said input module having a first paper input port and a first paper output port; and at least one marking module containing an imaging apparatus for creating a plurality of single-sided and two-sides copies in one or more colors, said marking module having a second paper input port and a second paper output port, said respective modules interchangeably connected by their respective paper input ports and paper output ports.

9. The apparatus as defined in claim 8 further comprising at least one productivity module containing a plurality of sorter bins for storing said one or more first or second imaged copies after said one or more first or second imaged copies exit said second paper output port, said productivity module having a third paper input port and a third paper output port, said respective modules interchangeably connected by their respective paper input ports and paper output ports.

10. The apparatus as defined in claim 9 further comprising at least one stacker module for stacking a completed set of said one or more first or second imaged copies, said stacker module having a fourth paper input port and a fourth paper output port; said respective modules interchangeably connected by their respective paper input ports and paper output ports.

* * * * *